United States Patent [19]

Gunther, Jr. et al.

[11] 4,179,111

[45] Dec. 18, 1979

[54] FOLDING MECHANISM

[75] Inventors: William H. Gunther, Jr., Mystic; Roman M. Golicz, Clinton; James W. Hough, Madison, all of Conn.

[73] Assignee: G. B. R., Ltd., Dover, Del.

[21] Appl. No.: 853,134

[22] Filed: Nov. 21, 1977

Related U.S. Application Data

[63] Continuation-in-part of Ser. No. 680,788, Apr. 27, 1976, Pat. No. 4,071,997.

[51] Int. Cl.[2] ..... B65H 45/14

[52] U.S. Cl. ..... 270/68 R

[58] Field of Search ..... 270/68 R, 61 R; 53/31; 93/84

[56] References Cited

U.S. PATENT DOCUMENTS

| | | | |
|---|---|---|---|
| 3,166,996 | 1/1965 | Sauerman | 270/68 R |
| 3,457,696 | 7/1969 | Berkley | 53/31 |
| 4,003,183 | 1/1977 | Helm | 53/31 |

FOREIGN PATENT DOCUMENTS

| | | | |
|---|---|---|---|
| 1390293 | 12/1965 | France | 270/68 R |

*Primary Examiner*—Edgar S. Burr
*Assistant Examiner*—A. Heinz
*Attorney, Agent, or Firm*—Holland, Armstrong, Wilkie & Previto

[57] ABSTRACT

A mechanism for folding a sheet, such as an envelope with an insert superimposed, means for moving said sheet and insert and means for folding the sheet around the insert. The folding means comprises a ramp having a stop at its forward end and having its rear end spaced above the plane of the moving means to form a gap. Means for causing the sheet to fold along a fold line and for pushing the folded sheet through said gap.

2 Claims, 4 Drawing Figures

FOLDING MECHANISM

CROSS-REFERENCE

This is a continuation-in-part of U.S. Patent application Ser. No. 680,788 filed Apr. 27, 1976 now U.S. Pat. No. 4,071,997 dated Feb. 7, 1978.

DESCRIPTION

The present invention is directed to an improved mechanism for folding a sheet, such as a paper sheet, and more particularly to a mechanism of folding an envelope around an insert.

As described is said application Ser. No. 680,788, the disclosure of which is incorporated herein by reference, in various operations, such as solicitations for subscribers, funds, billing etc. it is desirable for the envelope and the letter, or other message or insert, such as a return envelope, to be automatically placed inside the envelope. Even if the insert, letter, return envelope, etc. as well as the outer envelope, are automatically printed by a computer, it is an expensive and a time consuming operation to stuff the inserts into the corresponding envelope and to seal it.

The present invention has for one of its objects the provision of an improved mechanism which will automatically stuff letters and other inserts into an envelope, even with additional inserts added to the envelope, and which will automatically seal the contents within the envelope.

Other and further objects of the invention will be obvious upon and understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification, wherein.

Figure 1:
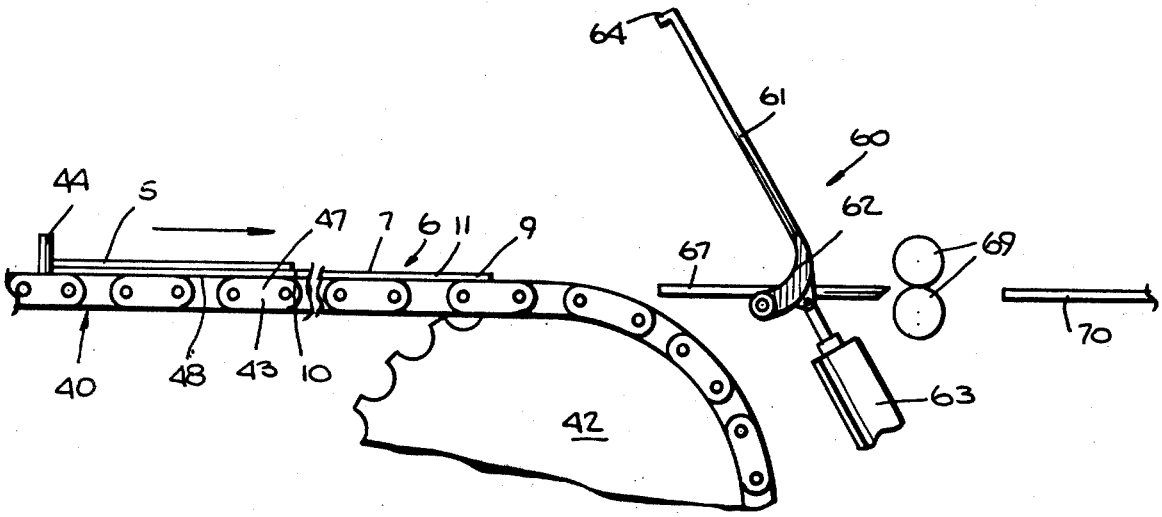
FIG. 1 is a side elevational view of the folding mechanism of the present invention before it starts its folding operation.
Figure 2:
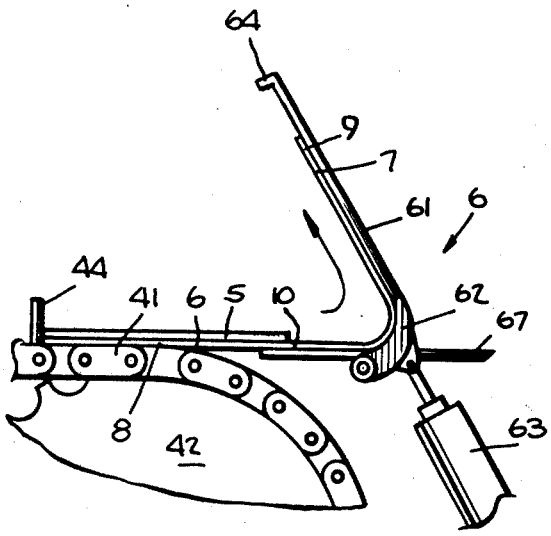
FIG. 2 is a detail showing the second step in the folding operation.
Figure 3:
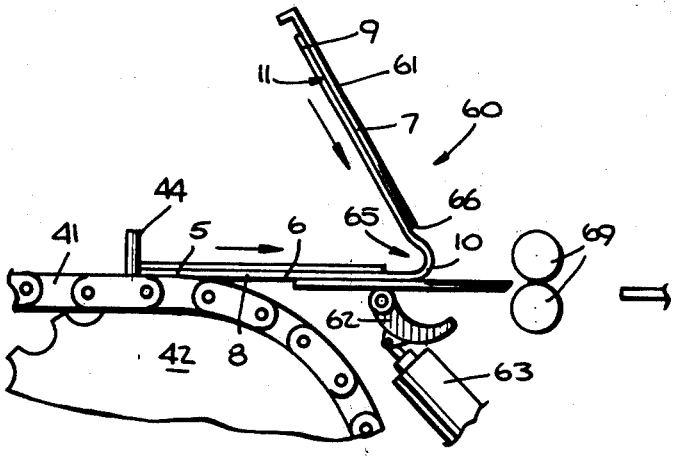
FIG. 3 is a detail showing the third step in the folding operation.
Figure 4:
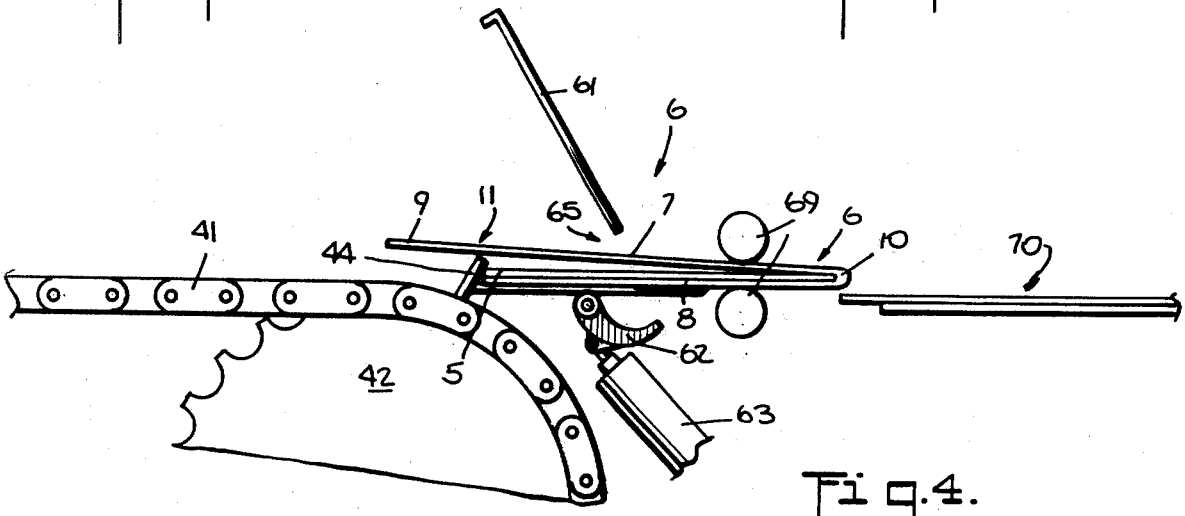
FIG. 4 is a detail showing another step in the operation.

As described in said pending application Ser. No. 680,788, the disclosure of which is incorporated herein by reference, an insert 5 and a folding assembly 6, which may be an envelope blank, or some other sheet, are adapted to be in superimposed relationship to each other with the insert assembly 5 resting on the folding assembly 6.

Each insert assembly 5 may have a message thereon and may be a letter or any other insert, including a return envelope.

Each folding assembly 6 has a front panel 7. If the folding assembly 6 is an envelope blank, it may be printed with a personalized address, which may correspond to the personalized address on insert assembly 5, if the insert assembly 5 is a letter or a return envelope. Each folding assembly 6 has a rear panel 8 attached to front panel 7 by a fold line 10 and flap 9 attached by fold line 11 to the front panel 7. The flap 9 may be sealed to the rear panel 8, especially if the folding assembly 6 is an envelope blank, or it may be merely folded over the panel 6 and/or 5. The flaps 9 may even be eliminated, if desired.

The folding assembly 6 is delivered (by means not shown herein) to a moving first conveyor assembly 40. The insert assembly 5 is delivered (by means not shown herein) onto, in superimposed relationship to and resting on, the folding assembly 6 which is moving with the conveyor assembly 40. The folding assembly 6 may receive an adhesive to permit its end edge areas to be sealed. At the appropriate time, the leading front panel 7 of the folding assembly 6 is folded over the previously deposited insert assembly 5 by a folding assembly 60 and the end edge areas which have previously received adhesive are pressed together to seal the end edges thereof.

After discharge from the first conveyor assembly 40, the folded assembly 6 may be placed on a mechanism, such as a moving second conveyor assembly 70, where the flap 9 may be folded over the rear panel 5 along fold line 11 and sealed thereto to complete the letter, if the folding assembly 6 is an envelope blank.

The conveyor assembly 40 comprises a continuously moving conveyor 41 driven by a wheel and chain assembly 42–43. The conveyor 41 has a plurality of transversely located, upwardly extending, longitudinally spaced drive pins 44. When the folding assembly 6 is deposited onto the conveyor 41, the pins 44 strike the rear edge of the folding assembly 6 to move it along with the conveyor 41. The pins 44 are adated not only to strike and move the folding assembly 6 but also to cause the letter assembly 5 and any additional inserts which may be deposited thereon, to be moved with the folding assembly 6.

The folding assembly 6, with insert assembly 5 thereon and any additional inserts, is then moved by pins 44 to an folding assembly 60 which comprises an upwardly inclined ramp 61 and at least one diverting finger means 62 adapted to divert the leading edge of the folding assembly 6 onto the ramp 61. The diverting finger means 62 is shown as being lowered by a hydraulic cylinder 63. However any other means, such as a cam, may be used to control the finger means 62. Preferably as shown, the ramp 61 is inclined about 60° toward the direction of the travel of the conveyor 40.

As the pins 44 move the folding assembly 6, together and with insert assembly 5, (as well as any other inserts) along, the diverting finger device 62 is in its raised position so that the leading edge of the folding assembly 6 embodying flap 9 moves up the ramp 61 until it strikes a stop 64. At that point, the device 62 is lowered to open a gap 65 between lower edge 66 of ramp 61 and feed plate 67. As the pins 44 continue to move the combination forward the folding assembly 6 buckles along fold line 10 and the folding assembly 6 is pushed through the gap 65.

Rollers 69 are provided adjacent the folding mechanism 60 and rotate faster than conveyor 40 so that as soon as the assembly 6 starts moving through gap 65 the rollers 69 pull it through the gap and onto conveyor 70. The rollers 69 also cause the two panels 8 and 7 of each folding assembly 6 to adhere to each other along their edges if an adhesive has been previously applied.

The folded assembly 6 may then move onto second conveyor 70 which may move at an angle (preferably at a right angle) to the first conveyor 40. The second conveyor 70 may move the folded assembly 6 past a flap folding mechanism (not shown) which is especially contoured to fold the flap 9 to complete the envelope if the assembly 6 is an envelope blank.

Hence, the present invention provides a machine and method which will automatically stuff a letter or some other insert into a envelope or some other folding assembly and which will automatically fold the envelope around the insert.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mechanism for folding a sheet comprising a conveyor, a ramp, a feed plate, a deflecting mechanism and a pulling roller, said conveyor terminating short of said pulling roller, said ramp, feed plate and deflecting mechanism being interposed between said conveyor and said pulling roller, said conveyor moving said sheet on a horizontal plane, said ramp extending upwardly away from said plane, said ramp being at an angle to said plane which is no greater than 90° to the direction from which the sheets are advancing, said ramp having a forward end and a rear end and having a stop at its forward end, said feed plate being located below said ramp to support said moving sheets in a horizontal plane, the rear end of said ramp being spaced above said feed plate to form a gap between said plane and rear end, said deflecting mechanism movable relative to said feed plate from a gap-closing position below said plane and out of the path of the sheet to open the gap to permit the folded sheet to pass through the gap along said feed plate and said pulling roller mounted to grasp the folded sheet after it moves through the gap and past said feed plate.

2. A mechanism as claimed in claim 1 wherein said moving means comprises a conveyor having pins extending upwardly therefrom to move the sheet along.

* * * * *